US005489101A

United States Patent [19]

Moody

[11] Patent Number: 5,489,101

[45] Date of Patent: Feb. 6, 1996

[54] POKER-STYLE CARD GAME

[76] Inventor: Ernest W. Moody, 4381 Pebble Beach Dr., Niwot, Colo. 80503

[21] Appl. No.: 470,341

[22] Filed: Jun. 6, 1995

[51] Int. Cl.[6] ..... A63F 1/00

[52] U.S. Cl. ..... 273/292

[58] Field of Search ..... 273/292, 274, 273/309, 856 P

[56] References Cited

U.S. PATENT DOCUMENTS

| | | | |
|---|---|---|---|
| 5,288,081 | 2/1994 | Breeding | 273/292 |
| 5,382,025 | 1/1995 | Sklansky | 273/292 |

OTHER PUBLICATIONS

Scarne's Encyclopedia of Card Games, 1983, ISBN 0–06–091052–6 (pbk), pp. 22–23.

Scarne's Encyclopedia of Card Games, 1983, ISBN 06–06–091052–6 (pbk), p. 23.

Scarne's Encyclopedia of Card Games, 1983, ISBN 0–06–091052–6 (pbk), pp. 23–28.

Scarne's Encyclopedia of Card Games, 1983, ISBN 0–06–091052–6 (pbk), pp. 43–45.

*Primary Examiner*—Benjamin H. Layno

*Attorney, Agent, or Firm*—John Edward Roethel

[57] ABSTRACT

The object of the game is for a player to form a five card poker hand that has the highest poker hand ranking. In the house banked version, all players play against the house and not against each other. The game is played with a standard fifty-two card deck. The game consists of a dealer and from one to seven players. Each player makes a bet and a portion of each bet may be allocated to a progressive jackpot. The dealer deals five cards to each player. The dealer then deals six cards as the community cards which are arranged face down in three rows in a triangle pattern on the gaming table layout. The players may discard from none to five unwanted cards. The dealer turns up the community cards and pre-designated groups of cards from the community cards are used for each player to make a complete five card poker hand. The dealer determines the best hand each player has made according to poker hand rankings. All winning hands will be paid by the dealer according to the odds listed in the pay table. When the progressive jackpot payout is used, the dealer examines the six community cards to determine if one of the predetermined card arrangements has occurred. Any winning payouts from the progressive jackpot are distributed to the players at the table. The method may also be played as a player banked game or as a pot game.

59 Claims, 9 Drawing Sheets

POKER-STYLE CARD GAME

This invention relates to a poker-style card game, and more particularly to a poker-style card game in which a player attempts to achieve a high ranking poker hand by discarding from his initial hand and using various pre-designated combinations of community cards.

BACKGROUND OF THE INVENTION

Poker-style card games have been played in gaming casinos for many years. Initially, gaming casinos provided segregated card rooms in which the poker players gather around a poker table and played whatever game was being dealt at that table. The gaming establishment provided the dealers, handled the exchange of money for gaming chips and took a "rake" (a percentage of each poker pot) as the fee for these services. Alternatively, instead of raking from each pot, the gaming establishment would simply charge a time based fee for providing the poker game.

This type of live poker played in legalized gaming establishments such as those in Nevada is not widely accepted by the average gaming patron. Most are afraid to play due to the reputation that "card sharks" are lurking in the poker room, waiting for the unsuspecting player to come along. The poker-style game of the present invention has been created to fill a need so that the average, novice or even first time poker player can participate in a live poker-style game without feeling he is being hustled.

Of the live poker games currently being offered in gaming jurisdictions, only two, Texas hold-em poker and seven card stud poker, enjoy any degree of popularity and play. Texas hold-em is by far the most popular poker game because of the large number of players who can play at One time and the fast action and large pots that are generated. The game is fast because only two cards are dealt to each player, with the remaining cards being dealt to a "flop" which forms the community cards from which each player makes up the rest of his hand. Each hand, however, has a single set of community cards which all players use as part of their poker hand. Therefore, the winning hand comes from that player whose two cards best fit with the community cards.

Texas hold-em is a difficult game for the novice player to learn to play because it takes considerable study, practice and a large bankroll to become a competent player. For this reason, many novice players avoid the game or are "run off" by the more experienced players who take full advantage of their lack of skill.

The other popular game, seven card stud, is well known to the average player and is easy to understand and play. The problem with this game for the novice player is that, even at low limits, with five rounds of betting and five raises, it can cost upwards of one hundred and fifty dollars just to play one hand. This is an expensive way for new players to get an education.

As a result of this many novice players avoid playing live poker altogether in the casinos. The current player base consists of a group of regular players who dominate the games and often regard the newcomers as "fish". These regulars, who are commonly called "poker bums" concentrate their play in only the larger casinos that have specialized card rooms and are better financed to feed and support them.

In other jurisdictions this problem has been addressed and an attempt has been made to fill the void by providing a variety of poker-style table games that are house banked and that are easily played and understood such as Caribbean Stud®Poker and Let It Ride®. A house banked game is a game in which the gaming establishment pays all winning hands and collects all losing hands. These games often feature progressive jackpots and have proved to be very popular with players of all types. These games however are structured as house banked games and as such are not permitted under the gaming regulations of many jurisdictions such as California and Colorado.

In those jurisdictions where house banked poker-style games are not permitted, poker-style games may only be dealt if one of the players at the gaming table is banking the game. That player takes the role of the house and pays all winning hands and collects all losing hands.

The current forms of poker currently being played for the reasons herein discussed have not been widely accepted by the average gaming patron. The poker-style card game of the present invention has been created in both its house banked version and its player banked version to fill a perceived need for the average, novice or first time player.

Additionally, with the advent of computer electronics, one player poker games played on electronic gaming machines have also become quite popular. Five card draw poker was the first poker game adapted to this format and the player attempts to achieve a high ranking poker hand from his initial five card dealt hand and any draw replacement cards he desires. A payout table is provided that pays the player various multiples of his wager depending on the rank of poker hand that the player achieves.

Since the introduction of electronic video draw poker, many other variations of poker have been adapted to electronic one player gaming machines. Joker's wild poker, deuces wild poker and five and seven card stud have all been programmed for play in this style—each with its own unique payout table reflecting the relative odds of achieving various poker hand rankings in each of these games.

The poker-style card game of the present invention is an attempt to provide a game which can be enjoyed by all classes of players including novices and less experienced players. It is designed to be played either as a stand alone pit game (such as Twenty-One or Blackjack) or in a segregated card room. The present invention is an attempt to incorporate the better features of both live table poker and electronic video poker into a single game.

The poker-style card game of the present invention can be played as a house banked game which means that the players do not compete against each other, but rather against the gaming establishment (as the players do in Twenty-One). In a house banked game, all player wins are paid by the gaming establishment and all player losses are collected by the gaming establishment.

Alternatively, the poker-style card game of the present invention can be played as a player banked game. In this version, one of the players at the table bankrolls the game and collects all losing wagers and pays all winning wagers.

The poker-style card game of the present invention can also be played as a "pot" game in the same manner as other poker games have been traditionally dealt in gaming casinos. In a "pot" game, a plurality of players sit at a common table with a dealer provided by the casino. The wagers made by each player are placed in a common pot and the player with the winning hand collects the pot.

It is an object of the present invention to provide a poker-style card game that allows each player to discard certain cards in that player's hand and then use pre-designated community cards as replacement cards to be considered part of that player's hand.

It is a further object of the present invention to provide a new poker-style card game that has a simplified betting structure and can be played either as a house banked game, a player banked game or a pot game.

It is a feature of the present invention that a plurality of community cards, arranged on the gaming table layout, are selectively used by the players to complete a poker hand. Depending on which cards the player discards, certain of the community cards are then designated as those used by the player to complete the player's hand.

It is a further feature of the present invention to provide for an optional progressive bonus feature as part of the play of the game.

It is an advantage of the present invention that the poker-style card game uses a simplified betting structure and community cards to speed play and allow more players to compete. Additionally the progressive bonus feature allows for the thrill of higher jackpots and more ways to win.

Other objects, features and advantages of the present invention will become apparent from a consideration of the following detailed description.

SUMMARY OF THE INVENTION

The object of the game is for a player to form a five card poker hand that has the highest poker hand ranking. The ranking used is the conventional poker hand rankings: Royal Flush, Straight Flush, Four-of-a-Kind, Full House, Flush, Straight, Three-of-a-Kind, Two Pair and a Pair of Jacks or better.

In the house banked version of the method of play of the present invention, all players play against the house and not against each other. The game is played with a standard fifty-two card deck. The game consists of a dealer and from one to seven players. Each player makes a bet and a portion of each bet may be allocated to a progressive jackpot.

The dealer deals five cards to each player. The dealer then deals six cards as the community cards which are arranged face down in three rows in a triangle pattern on the gaming table layout. The players may discard from none to five unwanted cards. The dealer turns up the community cards which are used by each player to make a complete five card poker hand. Depending on how many cards the player has discarded, the player's hand is completed by using certain pre-designated community cards. The dealer determines the best hand each player has made according to poker hand rankings. All winning hands will be paid by the dealer according to the odds listed in the pay table.

When the progressive jackpot bonus payout is used, the dealer examines the six community cards to determine if one of the predetermined card arrangements has occurred. Any winning payouts from the progressive bonus jackpot are distributed to the players at the table.

The method of the present invention may also be played as a player banked game or as a pot game.

DETAILED DESCRIPTION OF THE PREFERRED EMBODIMENTS

Version #1: House Banked Game

The object of the game is for a player to form a five card poker hand that has the highest poker hand ranking. The ranking used is the conventional poker hand rankings: Royal Flush, Straight Flush, Four-of-a-Kind, Full House, Flush, Straight, Three-of-a-Kind, Two Pair and a Pair of Jacks or better.

In the house banked version of the method of play of the present invention, all players play against the house and not against each other. The game is played with a standard fifty-two card deck. The cards can be shuffled and dealt by hand by a dealer, but in the preferred embodiment, an automatic shuffler is used.

The game consists of a dealer and from one to seven players. Each player makes a bet in the properly designated space 12 on the gaming table layout 10 used to play the game. The dealer counts the bets and, if a progressive jackpot is being used as part of the method of play, the dealer registers the total amount wagered on that round of play on a keyboard device (not shown) which causes a portion of the total amount wagered (e.g. one dollar per player or a pre-established percentage) to be registered on a progressive meter (not shown) from which the progressive jackpots are paid. The dealer makes all monetary transactions using the chips contained in the chip rack 18, as is conventional.

Figure 1:
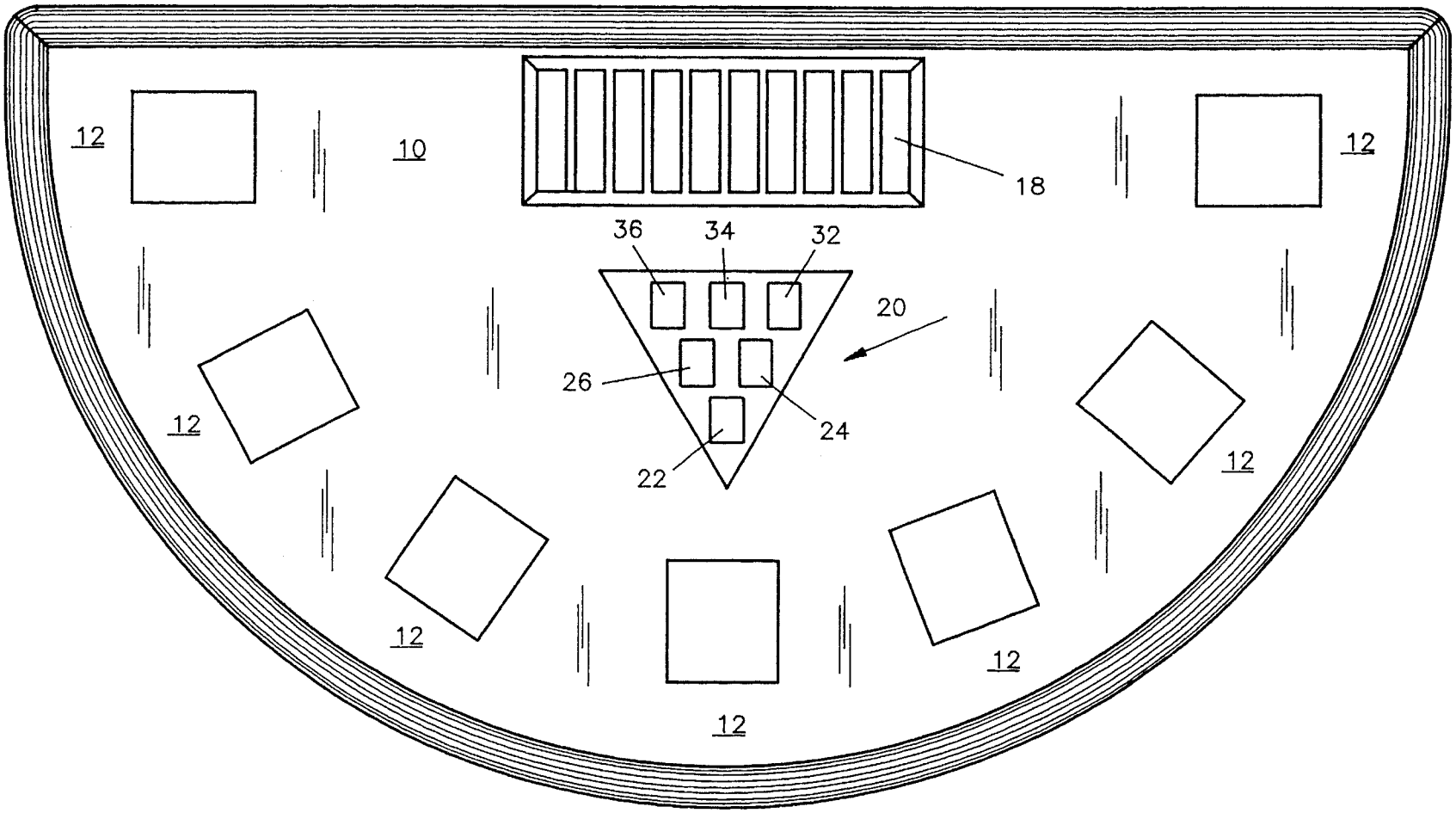
FIG. 1 shows a gaming table layout upon which the house banked version of the present invention may be played.

After the cards have been shuffled and cut according to established casino procedures, the dealer deals five cards to each player. The dealer then deals six cards as the community cards 20. As shown in FIG. 1, the cards are initially arranged face down in three rows in a triangle pattern with one card 22 at the vertex of the triangle, two cards 24 and 26 in the middle row of the triangle and three cards 32, 34 and 36 at the base of the triangle.

The players examine their hands and may at their option discard from none to five unwanted cards by placing them on a discard spot provided on the table layout. Each player takes his remaining cards and place them face down in front of him.

The dealer then turns up all of the community cards 20 and arranges them for each player to see. The dealer then turns up each player's cards, one player at a time beginning from the dealer's left. Depending on how many cards the player has discarded, certain of the community cards are designated as the replacement cards to be used by that player to complete his final five card hand.

For example, if the player has four cards in his hand, the one card 22 at the vertex of the triangle is used to complete that player's hand. If the player has three cards in his hand, the two cards 24 and 26 in the middle row of the triangle are used to complete that player's hand. If the player has two cards in his hand, the three cards 32, 34 and 36 at the base of the triangle are used to complete that player's hand. If a player has one card in his hand, the one card 22 at the vertex of the triangle and the three cards 32, 34 and 36 the base of the triangle are used to complete that player's hand. If the player has discarded all of his cards and has no cards remaining in his hand, the two cards 24 and 26 in the middle row of the triangle and the three cards 32, 34 and 36 at the base of the triangle are used to complete the player's hand. If a player has chosen not to discard, that player plays only the cards he was dealt. All cards physically remain in the triangle and the same rows may be used by more than one player.

The dealer determine the best hand each player has made and confirms it to the player. All winning hands will be paid by the dealer according to the odds listed in the pay table.

Figure 2:
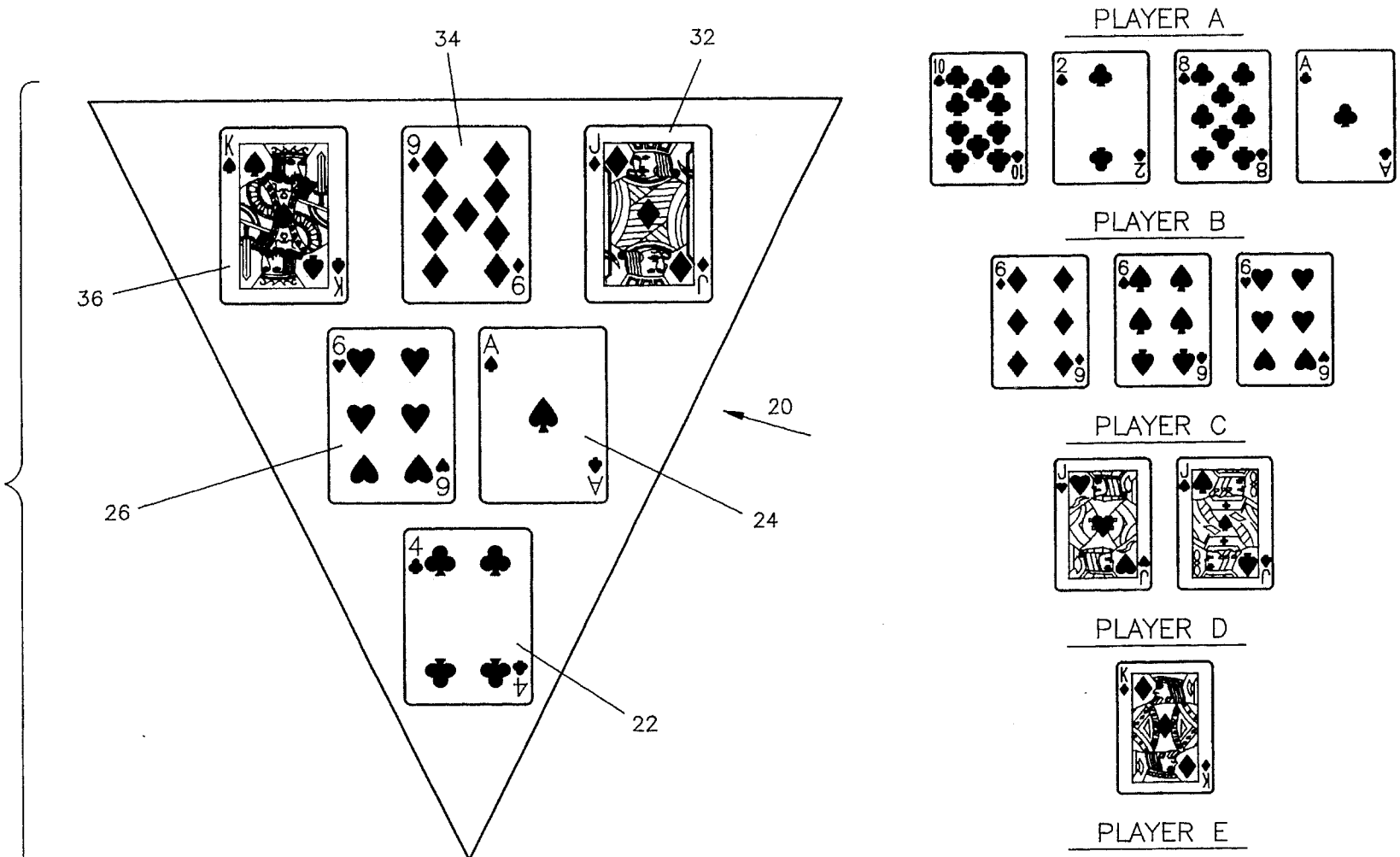
FIG. 2 shows a representation of a first community card layout used in the method of the present.

Referring to FIG. 2, for example, Player A has kept four clubs and the one card 22 at the vertex of the triangle when revealed is also a club. Player A has achieved a Flush.

As another example, Player B has kept three sixes and the two cards 24 and 26 in the middle row of the triangle when revealed include a six. Player B has Four-of-a-Kind.

Again, Player C has kept two Jacks and the three cards 32, 34 and 36 at the base of the triangle when revealed include a Jack. Player C has Three-of-a-Kind.

Likewise, Player D has kept an King and the four replacement cards (cards 22, 32, 34 and 36) when revealed include another King. Player D has a Pair of Kings.

Finally, Player E has discarded all of his cards and the five replacement cards (cards 24, 26, 32, 34 and 36) when revealed yield a hand having an Ace high. Player E has an Ace High.

There is nothing critical about which cards are pre-designated as the particular replacement cards to be used when a player discards from his initial hand. Any suitable pre-designation can be used. It is only important that the pre-designation be identified prior to the hand being dealt so that each player knows exactly which of the community cards will be included in his hand following his discard.

Figure 5:
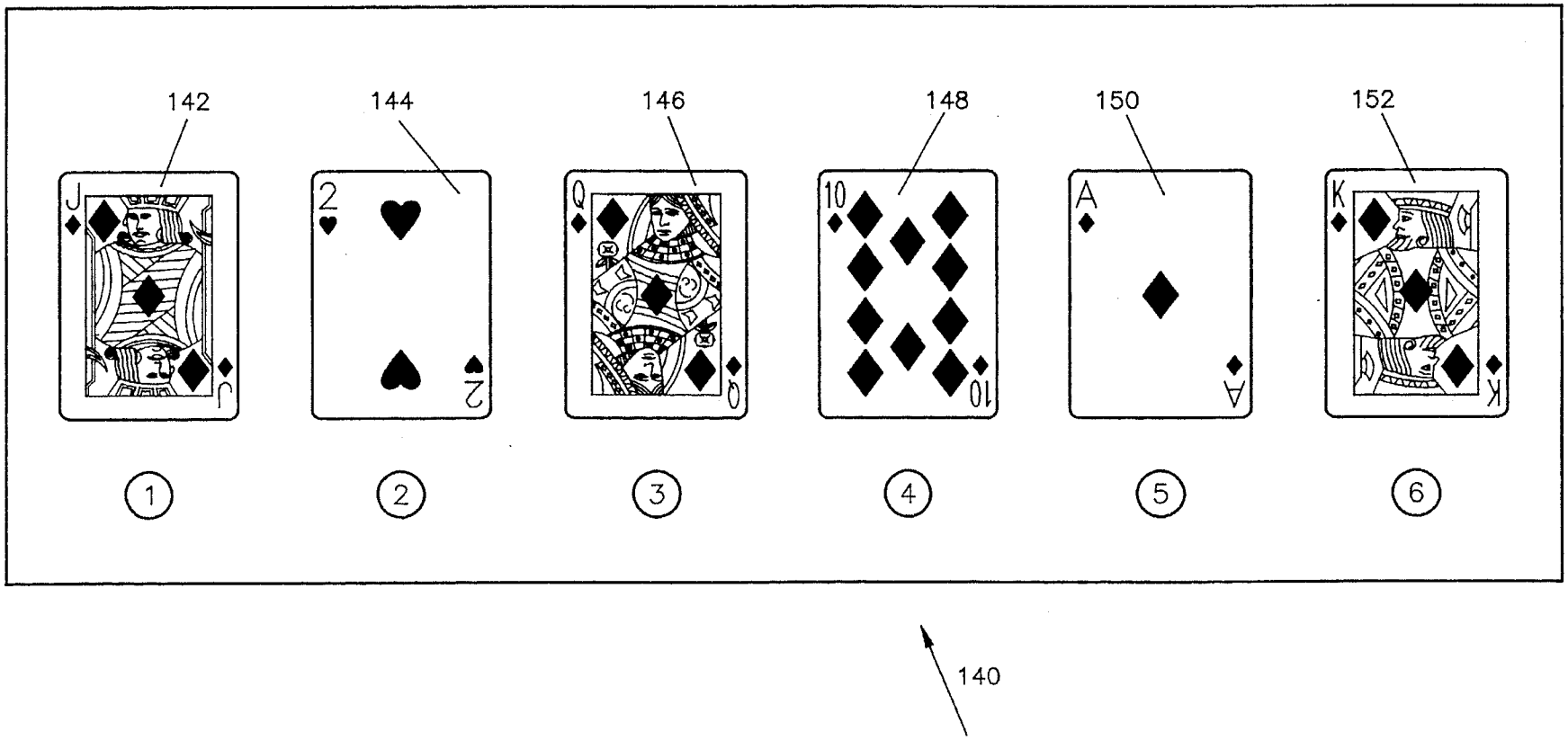
FIG. 5 shows a representation of another alternative community card layout as a single row of community cards used in the method of the present invention.

Instead of arranging the cards in a triangle arrangement, it is also possible to arrange the cards in other formats on the gaming table layout. For example, only five cards can be used as the community cards and these five cards 142, 144, 146, 148 and 150 could be aligned in a row across the gaming table with each card position being given a designated number, such as #1 through #5 as shown in FIG. 5. FIG. 5 also shows an optional sixth card 152 given the designated number #6, whose use will be explained below.

With reference to FIG. 5, if a player needs one card to complete his hand, the card 142 in position #1 on the gaming table layout is used by the player as that card has been pre-designated as the replacement card for a one card discard. If a player needs two cards to complete his hand, the cards 142 and 144 in positions #1 and #2 on the gaming table layout are used by the player as those cards have been pre-designated as the replacement cards for a two card discard. Similarly, if the player needs three or more cards to complete his hand, the cards that are provided would be consecutively counted from one end of the row.

A five community card display such as that shown in FIG. 5 can also be arranged in a triangle pattern similar to that shown in FIG. 2. In such a five card triangle pattern, the middle card of the three card base row of the triangle would be eliminated. As with the other embodiments described, certain of the community cards in such a five card triangle arrangement are designated as the replacement cards to be used by that player to complete his final five card hand.

For example, if the player has four cards in his hand, the one card at the vertex of the triangle is used to complete that player's hand. If the player has three cards in his hand, the two cards and in the middle row of the triangle are used to complete that player's hand. If the player has two cards in his hand, the one card at the vertex of the triangle and the two cards in the middle row of the triangle are used to complete that player's hand. If a player has one card in his hand, the two cards in the middle row of the triangle and the two cards in the base row of the triangle are used to complete that player's hand. If the player has discarded all of his cards and has no cards remaining in his hand, then all five cards of the triangle are used to complete the player's hand. If a player has chosen not to discard, that player plays only the cards he was dealt. All cards physically remain in the triangle and the same rows may be used by more than one player.

Again there is nothing critical about which cards are pre-designated as the particular replacement cards to be used when a player discards from his initial hand. Any suitable pre-designation can be used. It is only important that the pre-designation be identified prior to the hand being dealt so that each player knows exactly which of the community cards will be included in his hand following his discard.

Any other suitable layout of the community cards can be used as long as the method of play specifies which cards are the pre-designated cards that are used by each player to complete his hand based on the number of cards from his initial hand that the player discards. The cards could be arranged in a circle, in a square, in a rectangular, in any suitable geometric shape or even haphazardly on the table layout as long as the players know which community cards are associated with which number of discarded cards.

If a player has a winning hand as determined by the pay table, the player is paid off by the dealer according to the pay table based on the odds or payouts set out in the pay table times the amount of the player's wager. If a player does not have a winning hand, his bet 'is collected by the dealer on behalf of the gaming establishment.

The following table shows a preferred pay table to be used with the method of the present invention.

TABLE 1

| POKER HAND | PAYOUT ODDS |
|---|---|
| ROYAL FLUSH | 250 to 1 |
| STRAIGHT FLUSH | 50 to 1 |
| FOUR-OF-A-KIND | 25 to 1 |
| FULL HOUSE | 7 to 1 |
| FLUSH | 4 to 1 |
| STRAIGHT | 3 to 1 |
| THREE-OF-A-KIND | 2 to 1 |
| TWO PAIR | 1 to 1 |
| JACKS OF BETTER | 1 for 1 |

Assuming that each player described above had wagered five dollars as his bet, Player A having achieved a Flush would be paid $25.00 (his initial bet of $5 plus four times his initial bet). Player B having achieved Four-of-a-Kind would be paid $130.00, Player C having achieved Three-of-a-Kind would be paid $15.00 and Player D having achieved a pair of Aces would be paid $5.00 (a push of his original bet). Player E having only a Ace high hand would lose his wager.

After all bets have been reconciled, if the optional progressive jackpot feature is being used with the method of play, the dealer examines the six community cards in the triangle to see if a progressive jackpot bonus payout has occurred. Progressive jackpot bonus payouts occur whenever certain specific predetermined card arrangements appear in the community cards in the triangle.

Figure 3:
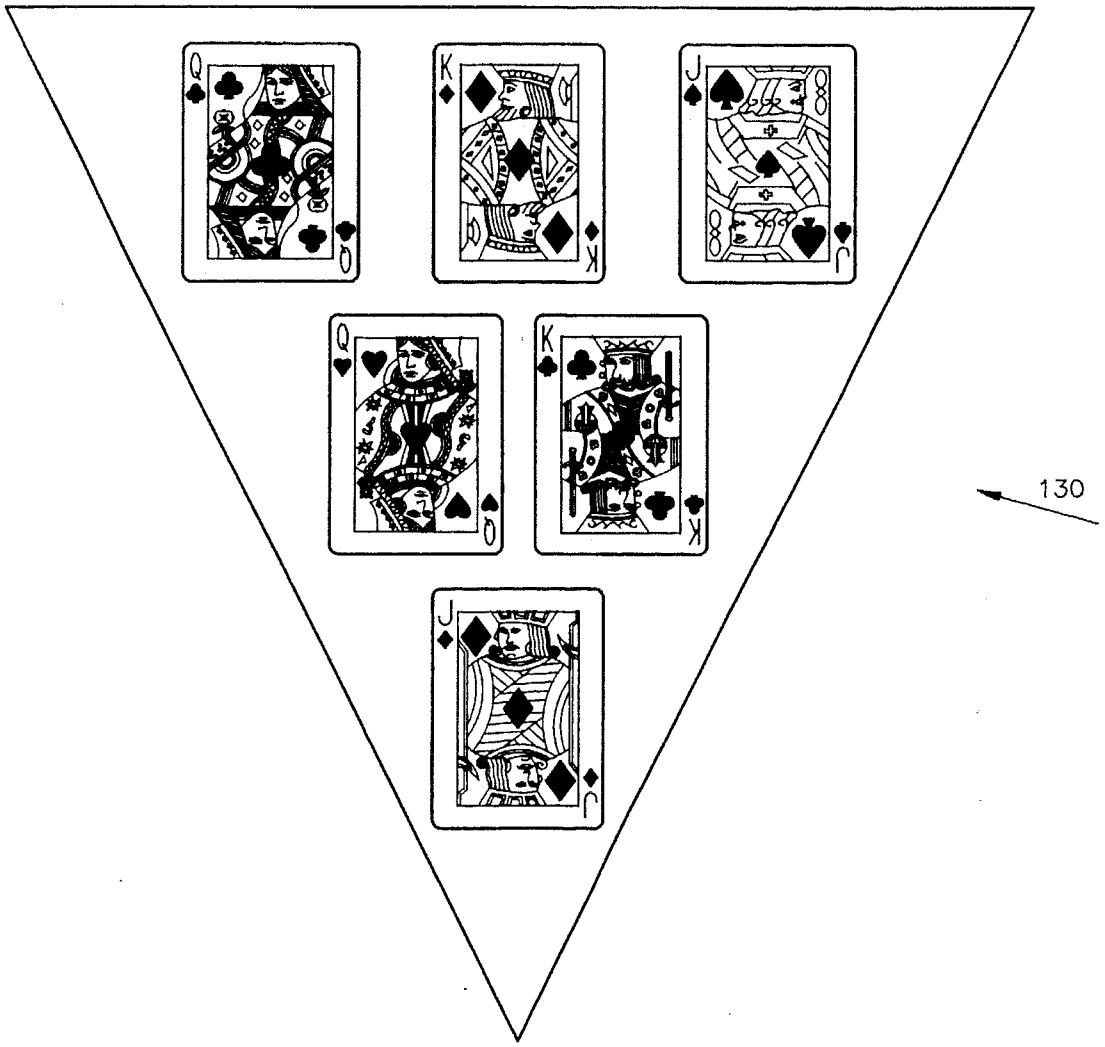
FIG. 3 shows a representation of a second community card layout used in the method of the present invention.
Figure 4:
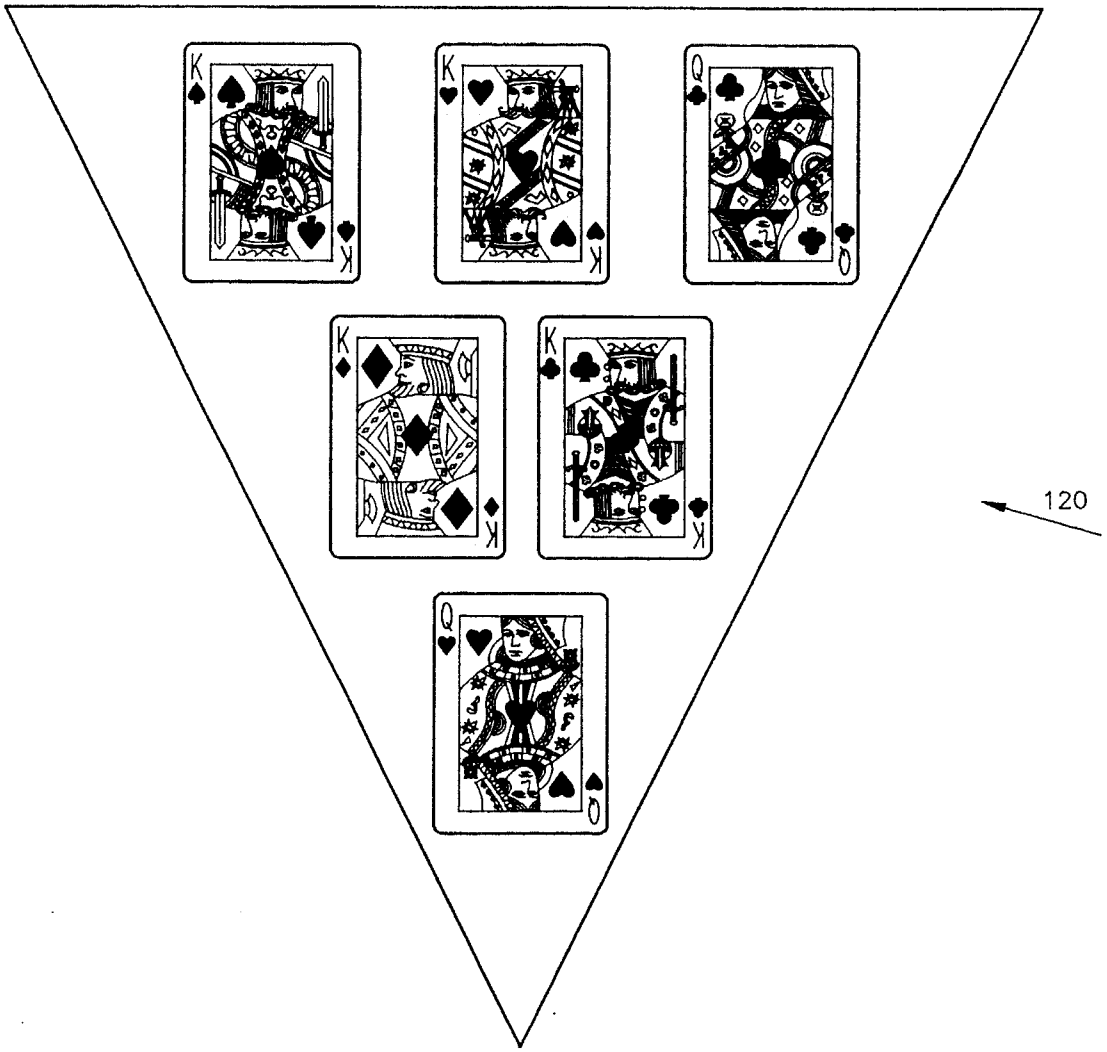
FIG. 4 shows a representation of a third community card layout used in the method of the present invention.

In the preferred embodiment of the present invention, the progressive jackpot meter is arranged so that two progressive jackpot amounts are shown. The money that is applied to the progressive jackpot meter is allocated in any desired fashion between the two progressive jackpot amounts. The following predetermined card arrangements are used to determine payouts from the progressive jackpot: All Face Cards wins 100% of the first progressive jackpot amount; and Four Kings and Two Face Cards wins 100% of the second progressive jackpot amount. FIG. 3 shows a group of community cards 120 that consist of All Face Cards which would win 100% of the first progressive jackpot amount. FIG. 4 shows a group of community cards 130 that consist of Four Kings and Two Face Cards which would win 100% of the second progressive jackpot amount. Any winning payouts from the progressive bonus jackpot are distributed to the players at the table, preferably in a pro rata distribution based on the amount of their individual wagers.

After having determined whether a progressive bonus jackpot win has occurred, the dealer collects the remaining cards, shuffles and play begins again.

Alternatively, different predetermined card arrangements can be used to determine winning hands for the progressive jackpot. Instead of having two progressive jackpot amounts, all money allocated to the progressive jackpot can be included as one large amount and various portions of the total amount can be paid out for different winning card arrangements.

Figure 6:
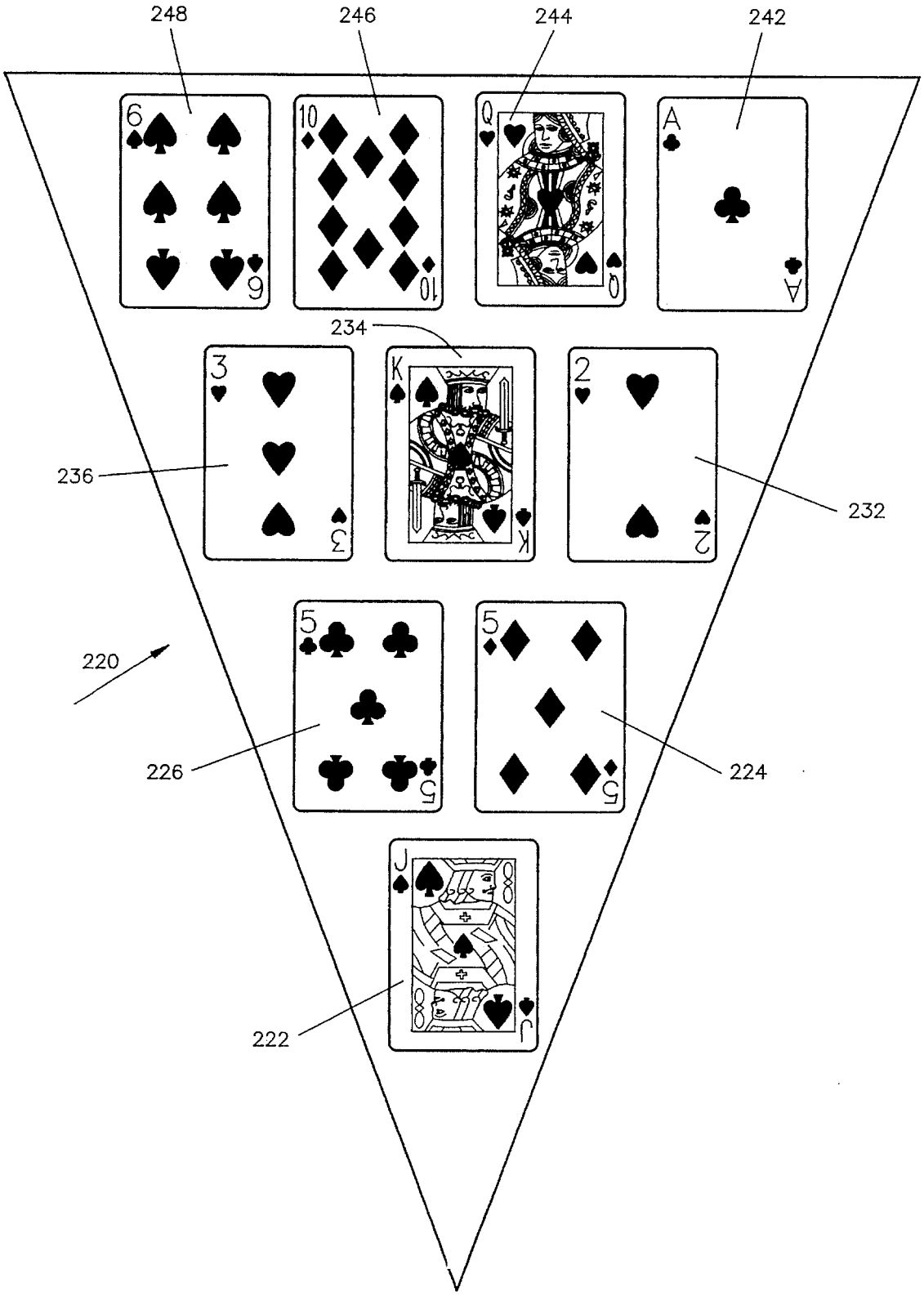
FIG. 6 shows a representation of another alternative community card layout having four rows of community cards used in the method of the present invention.

There are a number of alternative variations that can be used in the method of play of the present invention. In one variation, ten cards are used in the dealer triangle by adding a fourth row of cards at the base of the triangle 220 forming the community cards. This is shown in FIG. 6 with the fourth row of cards being 242, 244, 246 and 248. In this embodiment, the row having four cards is used by players who wish to discard four cards. Players discarding all five cards use as replacement cards the cards from the two card row 224 and 226 and the three card row 232, 234 and 236. A player discarding one card still uses the card 222 from the one card row, a player discarding two cards still uses the cards 224 and 226 from the two card row and a player discarding three cards still uses the cards 232, 234 and 236 from the three card row.

Other pre-designated groupings of cards can be used as long as the particular cards that will be substituted as replacement cards are all pre-designated based on the number of replacement cards a player will receive.

When the expanded layout of FIG. 6 is used, the progressive bonus jackpots payouts are adjusted to reflect this change.

Figure 7:
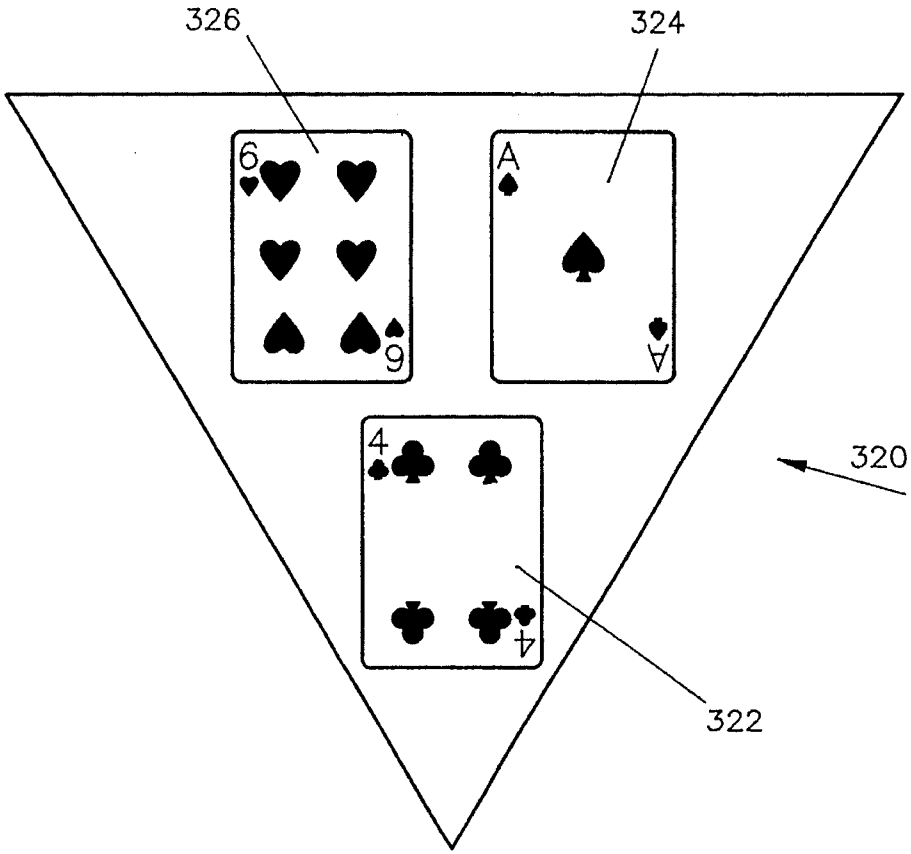
FIG. 7 shows a representation of another alternative community card layout having two rows of community cards, which number three cards in total and used in the method of the present invention.

In another variation, only three cards are used in the triangle 320 as shown in FIG. 7. Play of the game is the same except that players may only discard up to three cards and a player wishing to discard three cards will use all three cards in the community card triangle to complete their hands. If a player discards only one card, then replacement card 322 is used. If a player discards two cards, then replacement cards 324 and 326 are used. The progressive bonus jackpot would not be used when the group of community cards are only three cards.

Figure 8:
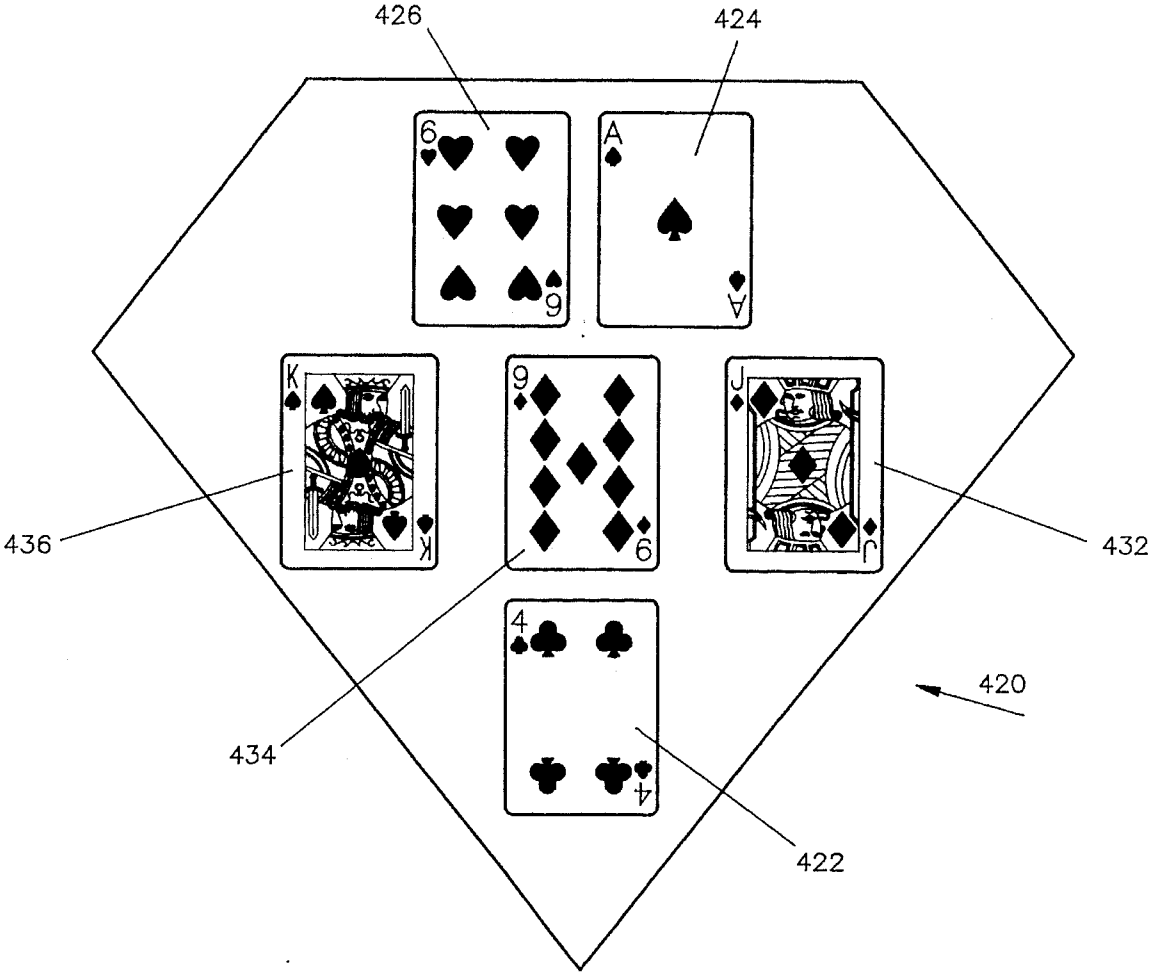
FIG. 8 shows a representation of another alternative community card layout having three rows of community cards, arranged inside a pentagon and used in the method of the present invention.

Besides using a triangle to contain the community cards, other shapes may be used. For example, FIG. 8 shows the use of a pentagon 420 to contain the six community cards in three rows. The row at the vertex of the pentagon 420 has one card, the middle row has three cards and the row at the base of the pentagon 420 has two cards.

If the player has four cards in his hand, the one card 422 at the vertex of the pentagon is used to complete that player's hand. If the player has three cards in his hand, the two cards 424 and 426 at the base of the pentagon are used to complete that player's hand. If the player has two cards in his hand, the three cards 432, 434 and 436 in the middle row of the pentagon are used to complete that player's hand. If a player has one card in his hand, the one card 422 at the vertex of the pentagon and the three cards 432,434 and 436 in the middle row of the pentagon are used to complete that player's hand. If the player has discarded all of his cards and has no cards remaining in his hand, the two cards 424 and 426 in the row at the base of the pentagon and the three cards 432, 434 and 436 in the middle row of the pentagon are used to complete the player's hand. If a player has chosen not to discard, that player plays only the cards he was dealt. All cards physically remain in the pentagon and the same rows may be used by more than one player.

Figure 9:
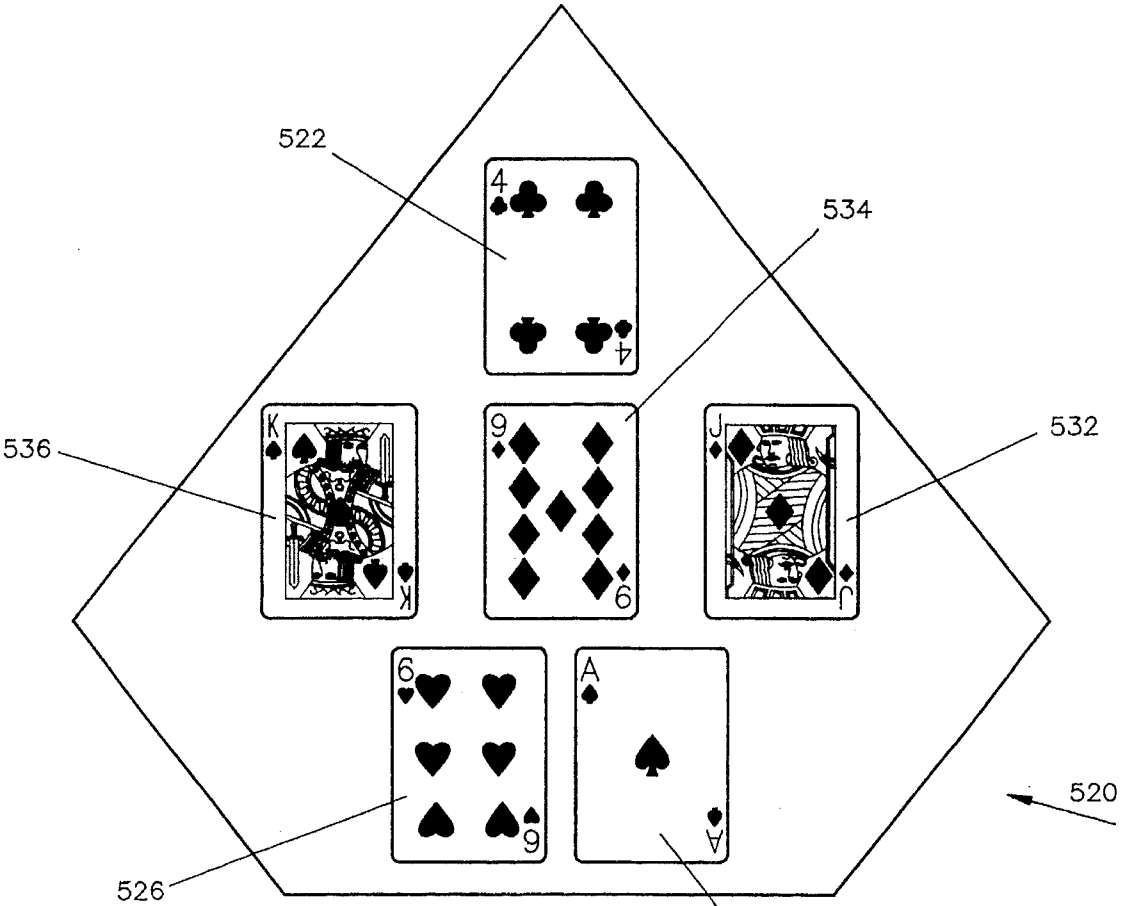
FIG. 9 shows a representation of another alternative community card layout having three rows of community cards, arranged inside a pentagon and used in the method of the present invention.

FIG. 9 shows another pentagon 520 quite similar to that shown in FIG. 8, but reversed with regard to the direction that the vertex of the pentagon 520 faces. The row at the vertex of the pentagon 520 has one card, the middle row has three cards and the row at the base of the pentagon 520 has two cards.

If the player has four cards in his hand, the one card 522 at the vertex of the pentagon is used to complete that player's hand. If the player has three cards in his hand, the two cards 524 and 526 at the base of the pentagon are used to complete that player's hand. If the player has two cards in his hand, the three cards 532, 534 and 536 in the middle row of the pentagon are used to complete that player's hand. If a player has one card in his hand, the one card 522 at the vertex of the pentagon and the three cards 532,534 and 536 in the middle row of the pentagon are used to complete that player's hand. If the player has discarded all of his cards and has no cards remaining in his hand, the two cards 524 and 526 in the row at the base of the pentagon and the three cards 532, 534 and 536 in the middle row of the pentagon are used to complete the player's hand. If a player has chosen not to discard, that player plays only the cards he was dealt. All cards physically remain in the pentagon and the same rows may be used by more than one player.

In another variation, if it is desired to use the progressive jackpot variation with a straight line display of the community cards as shown in FIG. 5, a sixth card 152 is added to the row of community cards 140. The payouts on the progressive jackpot, using either one or two jackpot amounts, would then be the same as described above in connection with FIGS. 3 and 4. Alternatively, instead of using all Face Cards or Four Kings and Two Face. Cards as the winning arrangements for the progressive jackpot, a winning arrangement such as a Royal Flush could be used. The cards shown in FIG. 5 would yield a Royal Flush when the sixth card 152 is included for the progressive jackpot.

In yet another variation, the progressive bonus jackpot payouts based on combinations of the group of community cards is eliminated and is replaced by a Royal Flush or other progressive jackpot that is awarded to individual players who achieve that hand. As above, any suitable arrangement of cards can be used when paying a player all or a portion of the progressive jackpot for the individual hand achieved by the player.

Furthermore, the progressive jackpot bonus can be used on a five card straight line layout or a five card triangle arrangement. It is not necessary to add a sixth card to either of these layouts to use the progressive jackpot bonus. A suitable predetermined arrangement of the community cards can be used to establish a winning progressive jackpot bonus hand; for example, a five card Royal Flush of the community cards can result in the player's being awarded the progressive jackpot bonus. This jackpot can be split among the players at the table or it can be awarded only to those players who have made a second wager to be eligible for the progressive jackpot bonus. This feature is not limited to a Royal Flush combination as the winning predetermined arrangement; any suitable combinations of cards can be predetermined as the winning jackpot bonus hand.

Version #2: Player banked game

In the player banked version of the present invention, one of the players takes the place of the house and assumes the responsibility for paying winning hands and collecting losing wagers. The game is played with a standard fifty two card deck, from two to nine players, and a non-player dealer.

Each player (except the player banking the game) makes a bet in the properly designated space. This bet is a fixed amount and is determined by the table limits. The dealer counts the bets and, if a progressive jackpot is being used as part of the method of play, the dealer registers the total amount wagered on that round of play on a keyboard device (not shown) which causes a portion of the total amount wagered (e.g. one dollar per player or a pre-established percentage) to be registered on a progressive meter (not shown) from which the progressive jackpots are paid. He also separates the rake chips (the house's fee for providing the game) and places them on the designated spot.

After the cards have been shuffled and cut according to established casino procedures, the dealer deals five cards to each player. To speed play, an automatic poker shuffler is used wherever possible. The dealer burns a card and deals six cards to himself, arranging them face down in three rows in a triangle pattern with one card in the first row, two cards in the second row, and three in the third row.

The players examine their hands and may at their option discard from none to five unwanted cards by placing them on the discard spot. The players take their remaining cards and place them face down in front of them.

The dealer turns the cards in the triangle face up. Beginning on his left, the dealer turns up the players'cards one player at a time. Depending on the number of cards remaining in each player's hand, the player uses cards from a corresponding row in the triangle to make a complete five card poker hand.

For example, if the player has four cards in his hand he would use the one card at the vertex of the triangle, if he has three cards in his hand he would use the two cards in the middle row, if he has two cards in his hand he would use the three cards in the base row of the triangle and if he has one card he would use the one card at the vertex of the triangle and the three cards at the base of the triangle (in the same manner as described above with reference to the house banked game). If a player has chosen not to discard, he plays only the cards he was dealt. All cards remain in the triangle and the same cards may be used by more than one player.

The dealer determines which players have winning hands and the player banking the game pays the winning players according to the payout schedule in the same manner that the house would pay winning players in the house banked version of the present invention. The player banking the game also collects all losing wagers.

The same variations as to the community card arrangement and the number of cards that may be discarded as discussed above relative to the house banked version of the game may also be applied to the player banked version of the game. The optional progressive jackpot feature may also be used.

Version #3: Pot game

In the pot game version of the present invention, a plurality of players play against one another with the player having the highest hand winning the pot. The game is played with a standard fifty two card deck, from two to nine players, and a non-player dealer.

Each player makes a bet which is placed in the pot in the center of the table. This bet is a fixed amount and is determined by the table limits. The dealer counts the bets and, if a progressive jackpot is being used as part of the method of play, the dealer registers the total amount wagered on that round of play on a keyboard device (not shown) which causes a portion of the total amount wagered (e.g. one dollar per player or a pre-established percentage) to be registered on a progressive meter (not shown) from which the progressive jackpots are paid. He also separates the rake chips (the house's fee for providing the game) and places them on the designated spot.

After the cards have been shuffled and cut according to established casino procedures, the dealer deals five cards to each player. To speed play, an automatic poker shuffler is used wherever possible. The dealer burns a card and deals six cards to himself, arranging them face down in three rows in a triangle pattern with one card in the first row, two cards in the second row, and three in the third row.

The players examine their hands and may at their option discard from none to five unwanted cards by placing them on the discard spot. The players take their remaining cards and place them face down in front of them.

The dealer turns the cards in the triangle face up. Beginning on his left, the dealer turns up the players'cards one player at a time. Depending on the number of cards remaining in each player's hand, the player uses cards from a corresponding row in the triangle to make a complete five card poker hand.

For example, if the player has four cards in his hand he would use the one card at the vertex of the triangle, if he has three cards in his hand he would use the two cards in the middle row, if he has two cards in his hand he would use the three cards in the base row of the triangle and if he has one card he would use the one card at the vertex of the triangle and the three cards at the base of the triangle (in the same manner as described above with reference to the house banked game). If a player has chosen not to discard, he plays only the cards he was dealt. All cards remain in the triangle and the same cards may be used by more than one player.

The dealer determines which player has the highest ranking poker hand and confirms it to the table and awards the pot to the winner.

The same variations as to the community card arrangement and the number of cards that may be discarded as discussed above relative to the house banked version of the game may also be applied to the pot game version of the game.

The optional progressive jackpot feature may also be used in this pot game version. The dealer examines the cards constituting the winning hand to see if the combination of cards in the winning hand qualifies for a progressive jackpot payout. In the preferred embodiment, this payout is made for high ranking hands such as a Royal Flush, Straight Flush, Four-of-a-Kind or Full House and is paid by the dealer to the player holding the winning hand. The amount of the payout is determined according to a progressive bonus pay table.

This jackpot may be paid as a percentage of the amount of money shown on the progressive jackpot meter or as a fixed amount of dollars for some of the lower ranking hands. Only the player holding the winning hand is entitled to win the progressive jackpot payout. In case of a tie between two or more players, the progressive jackpot payout is divided equally between all winning hands.

Any amounts paid from the progressive are automatically subtracted from the progressive meter. No money is taken by the house from the progressive meter and all money on the meter is returned to the players in the form of winning progressive jackpot payouts.

Various modifications made by made to basic method of play of the present invention. At the option of the gaming establishment, Three-of-a-Kind or better may be required to win the pot. If no one wins the pot, the chips wagered by the players for that round of the game remain in the pot and a new round of the game is played with a new round of bets until there is a winner of the pot.

Instead of awarding a progressive jackpot payout to the player with a qualifying winning hand, the gaming establishment may choose to award a progressive jackpot payout to all of the players whenever certain predetermined card combinations occur in the group of community cards. For example, all or a portion of the progressive jackpot may be awarded whenever the community cards are all Face Cards or all Face Cards of the Same Color. This bonus payout would be shared equally by all players who are in the hand.

As was described above in connection with the house banked version of the present invention, the various community card arrangements used therein may alternatively be used in either the player banked version of the pot game version of the present invention.

Additionally, the game of the present invention may also be played with a second round of betting before the cards are discarded giving players an option to call an additional bet or fold. No raises would be permitted in the preferred embodiment of this variation. In this embodiment, it is preferred that the deal would rotate and a dealer button would be used as is conventional.

At the option of the gaming establishment conducting the game of the present invention, two or more tables at which the game is being dealt may be linked together on the same progressive jackpot meter.

The method of the present invention can also be adapted to a video gaming device in much the same manner as Draw Poker has been adapted to a video gaming device. The electronic gaming machine is provided with a video monitor that displays both the community cards and the player's hand. The player inserts a coin or token to activate the electronic gaming machine and presses the deal button to display the cards. By pressing either various buttons that will be provided, the player determines whether to receive additional cards, and how many. After the player completes the selection, the gaming machine displays the results of the play and awards the player any winning amounts to which the player may be entitled. The method of the present invention is intended to cover both the live gaming table version of the game as well as an electronic video gaming machine version of the game.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a poker-style game using a standard deck of playing cards comprising:

a) dealing an initial hand of five cards to a player;

b) arranging a group of community cards comprising six cards from the deck in a predetermined pattern in which certain of the community cards are designated as a one card replacement card; a two card replacement cards; a three card replacement cards; a four card replacement cards; and a five card replacement cards;

c) permitting the player to discard up to five cards from the player's initial hand;

d) if the player discards one card, using the one card replacement card to complete the player's hand;

e) if the player discards two cards, using the two card replacement cards to complete the player's hand;

f) if the player discards three cards, using the three card replacement cards to complete the player's hand;

g) if the player discards four cards, using the four card replacement cards to complete the player's hand;

h) if the player discards five cards, using the five card replacement cards to complete the player's hand; and i) examining the player's completed hand to determine a poker hand ranking thereof.

2. The method of claim 1 in which the community cards are arranged in a triangle.

3. The method of claim 1 in which the community cards are arranged in a straight line.

4. The method of claim 1 in which the community cards are arranged in a pentagon.

5. A method of playing a poker-style game using a standard deck of playing cards comprising:

a) dealing an initial hand of five cards to a player;

b) arranging a group of community cards comprising six cards from the deck in a predetermined pattern in which a first card is designated as a one card replacement card; a second card and a third card are designated as a two card replacement cards; a fourth card, fifth card and sixth card are designated as a three card replacement cards; the first card, fourth card, fifth card and sixth card are designated as a four card replacement cards; and the second card, third card, fourth card, fifth card and sixth card are designated as a five card replacement cards;

c) permitting the player to discard up to five cards from the player's initial hand;

d) if the player discards one card, using the one card replacement card to complete the player's hand;

e) if the player discards two cards, using the two card replacement cards to complete the player's hand;

f) if the player discards three cards, using the three card replacement cards to complete the player's hand;

g) if the player discards four cards, using the four card replacement cards to complete the player's hand;

h) if the player discards five cards, using the five card replacement cards to complete the player's hand; and i) examining the player's completed hand to determine a poker hand ranking thereof.

6. The method of claim 5 in which the community cards are arranged in a triangle.

7. The method of claim 5 in which the community cards are arranged in a pentagon.

8. A method of playing a poker-style game using a standard deck of playing cards comprising:

a) a player making a wager to participate in the game;

b) dealing an initial hand of five cards to a player;

c) arranging a group of community cards comprising six cards from the deck in a predetermined pattern in which certain of the community cards are designated as a one card replacement card; a two card replacement cards; a three card replacement cards; a four card replacement cards; and a five card replacement cards;

d) permitting the player to discard up to five cards from the player's initial hand;

e) if the player discards one card, using the one card replacement card to complete the player's hand;

f) if the player discards two cards, using the two card replacement cards to complete the player's hand;

g) if the player discards three cards, using the three card replacement cards to complete the player's hand;

h) if the player discards four cards, using the four card replacement cards to complete the player's hand;

i) if the player discards five cards, using the five card replacement cards to complete the player's hand;

j) examining the player's completed hand to determine a poker hand ranking thereof; and k) paying the player a pre-established amount based on the poker hand ranking achieved by the player's completed hand.

9. The method of claim 8 in which the community cards are arranged in a triangle.

10. The method of claim 8 in which the community cards are arranged in a straight line.

11. The method of claim 8 in which the community cards are arranged in a pentagon.

12. The method of claim 8 in which the pre-established amount to be paid to the player is based'on a payout table.

13. The method of claim 12 in which the payout table comprises:

| POKER HAND | PAYOUT ODDS |
|---|---|
| ROYAL FLUSH | 250 to 1 |
| STRAIGHT FLUSH | 50 to 1 |
| FOUR-OF-A-KIND | 25 to 1 |
| FULL HOUSE | 7 to 1 |
| FLUSH | 4 to 1 |
| STRAIGHT | 3 to 1 |
| THREE-OF-A-KIND | 2 to 1 |
| TWO PAIR | 1 to 1 |
| JACKS OF BETTER | 1 for 1 |

14. The method of claim 8 further comprising:

a) allocating a portion of the wager to a progressive jackpot; and b) paying the player a pre-established amount of the progressive jackpot if the community cards form a predetermined arrangement of cards.

15. The method of claim 14 in which the player is paid all of the progressive jackpot if the community cards are four kings and two other face cards.

16. The method of claim 14 in which the player is paid a portion of the progressive jackpot if the community cards are all face cards.

17. The method of claim 14 in which the player is paid all of the progressive jackpot if the community cards form a Royal Flush.

18. The method of claim 8 further comprising:

a) allocating a portion of the wager to a first progressive jackpot and a second progressive jackpot;

b) paying the player a pre-established amount of the first progressive jackpot if the community cards are all face cards; and c) paying the player a pre-established amount of the second progressive jackpot if the community cards are four kings and two other face cards.

19. A method of playing a poker-style game using a standard deck of playing cards comprising:

a) a player making a wager to participate in the game;

b) dealing an initial hand of five cards to the player;

c) arranging a group of community cards comprising six cards from the deck in a predetermined pattern in which a first card is designated as a one card replacement card; a second card and a third card are designated as a two card replacement cards; a fourth card, fifth card and sixth card are designated as a three card replacement cards; the first card, fourth card, fifth card and sixth card are designated as a four card replacement cards; and the second card, third card, fourth card, fifth card and sixth card are designated as a five card replacement cards;

d) permitting the player to discard up to five cards from the player's initial hand;

e) if the player discards one card, using the one card replacement card to complete the player's hand;

f) if the player discards two cards, using the two card replacement cards to complete the player's hand;

g) if the player discards three card, using the three card replacement cards to complete the player's hand;

h) if the player discards four cards, using the four card replacement cards to complete the player's hand;

i) if the player discards five cards, using the five card replacement cards to complete the player's hand;

j) examining the player's completed hand to determine a poker hand ranking thereof; and k) paying the player a pre-established amount based on the poker hand ranking achieved by the player's completed hand.

20. The method of claim 19 in which the community cards are arranged in a triangle.

21. The method of claim 19 in which the community cards are arranged in a pentagon.

22. The method of claim 19 in which the pre-established amount to be paid to the player is based on a payout table.

23. The method of claim 22 in which the payout table comprises:

| POKER HAND | PAYOUT ODDS |
|---|---|
| ROYAL FLUSH | 250 to 1 |
| STRAIGHT FLUSH | 50 to 1 |
| FOUR-OF-A-KIND | 25 to 1 |
| FULL HOUSE | 7 to 1 |
| FLUSH | 4 to 1 |
| STRAIGHT | 3 to 1 |
| THREE-OF-A-KIND | 2 to 1 |
| TWO PAIR | 1 to 1 |
| JACKS OF BETTER | 1 for 1 |

24. The method of claim 19 further comprising:

a) allocating a portion of the wager to a progressive jackpot; and b) paying the player a pre-established amount of the progressive jackpot if the community cards form a predetermined arrangement of cards.

25. The method of claim 24 in which the player is paid all of the progressive jackpot if the community cards are four kings and two other face cards.

26. The method of claim 24 in which the player is paid a portion of the progressive jackpot if the community cards are all face cards.

27. The method of claim 24 in which the player is paid all of the progressive jackpot if the community cards form a Royal Flush.

28. The method of claim 19 further comprising:

a) allocating a portion of the wager to a first progressive jackpot and a second progressive jackpot;

b) paying the player a pre-established amount of the first progressive jackpot if the community cards are all face cards; and c) paying the player a pre-established amount of the second progressive jackpot if the community cards are four kings and two other face cards.

29. A method of playing a poker-style game using a standard deck of playing cards comprising:

a) dealing an initial hand of five cards to a player;

b) arranging a group of community cards comprising three cards from the deck in a predetermined pattern in which a first card is designated as a one card replacement card; a second card and a third card are designated as a two card replacement cards; and the first card, second card and third card are designated as a three card replacement cards;

c) permitting the player to discard up to three cards from the player's initial hand;

d) if the player discards one card, using the one card replacement card to complete the player's hand;

e) if the player discards two cards, using the two card replacement cards to complete the player's hand;

f) if the player discards three cards, using the three card replacement cards to complete the player's hand; and g) examining the player's completed hand to determine a poker hand ranking thereof.

30. The method of claim 29 in which the community cards are arranged in a triangle.

31. The method of claim 29 in which the community cards are arranged in a straight line.

32. A method of playing a poker-style game using a standard deck of playing cards comprising:

a) a player making a wager to participate in the game;

b) dealing an initial hand of five cards to a player;

c) arranging a group of community cards comprising three cards from the deck in a predetermined pattern in which a first card is designated as a one card replacement card; a second card and a third card are designated as a two card replacement cards; and the first card, second card and third card are designated as a three card replacement cards;

d) permitting the player to discard up to three cards from the player's initial hand;

e) if the player discards one card, using the one card replacement card to complete the player's hand;

f) if the player discards two cards, using the two card replacement cards to complete the player's hand;

g) if the player discards three cards, using the three card replacement cards to complete the player's hand;

h) examining the player's completed hand to determine a poker hand ranking thereof; and i) paying the player a pre-established amount based on the poker hand ranking achieved by the player's completed hand.

33. The method of claim 32 in which the community cards are arranged in a triangle.

34. The method of claim 32 in which the community cards are arranged in a straight line.

35. The method of claim 32 in which the pre-established amount to be paid to the player is based on a payout table.

36. The method of claim 35 in which the payout table comprises:

| POKER HAND | PAYOUT ODDS |
|---|---|
| ROYAL FLUSH | 250 to 1 |
| STRAIGHT FLUSH | 50 to 1 |
| FOUR-OF-A-KIND | 25 to 1 |
| FULL HOUSE | 7 to 1 |
| FLUSH | 4 to 1 |
| STRAIGHT | 3 to 1 |
| THREE-OF-A-KIND | 2 to 1 |
| TWO PAIR | 1 to 1 |
| JACKS OF BETTER | 1 for 1 |

37. A method of playing a poker-style game using a standard deck of playing cards comprising:

a) dealing an initial hand of five cards to a player;

b) arranging a group of community cards comprising ten cards from the deck in a predetermined pattern in which a first card is designated as a one card replacement card; a second card and a third card are designated as a two card replacement cards; a fourth card, fifth card and sixth card are designated as a three card replacement cards; a seventh card, an eighth card, a ninth card and a tenth card are designated as a four card replacement cards; and the second card, third card, fourth card, fifth card and sixth card are designated as a five card replacement cards;

c) permitting the player to discard up to five cards from the player's initial hand;

d) if the player discards one card, using the one card replacement card to complete the player's hand;

e) if the player discards two cards, using the two card replacement cards to complete the player's hand;

f) if the player discards three cards, using the three card replacement cards to complete the player's hand;

g) if the player discards four cards, using the four card replacement cards to complete the player's hand;

h) if the player discards five cards, using the five card replacement cards to complete the player's hand; and i) examining the player's completed hand to determine a poker hand ranking thereof.

38. The method of claim 37 in which the community cards are arranged in a triangle.

39. The method of claim 37 in which the community cards are arranged in a straight line.

40. A method of playing a poker-style game using a standard deck of playing cards comprising:

a) a player making a wager to participate in the game;

b) dealing an initial hand of five cards to a player;

c) arranging a group of community cards comprising ten cards from the deck in a predetermined pattern in which a first card is designated as a one card replacement card; a second card and a third card are designated as a two card replacement cards; a fourth card, fifth card and sixth card are designated as a three card replacement cards; a seventh card, an eighth card, a ninth card and a tenth card are designated as a four card replacement cards; and the second card, third card, fourth card, fifth card and sixth card are designated as a five card replacement cards;

d) permitting the player to discard up to five cards from the player's initial hand;

e) if the player discards one card, using the one card replacement card to complete the player's hand;

f) if the player discards two cards, using the two card replacement cards to complete the player's hand;

g) if the player discards three cards, using the three card replacement cards to complete the player's hand;

h) if the player discards four cards, using the four card replacement cards to complete the player's hand;

i) if the player discards five cards, using the five card replacement cards to complete the player's hand;

j) examining the player's completed hand to determine a poker hand ranking thereof; and k) paying the player a pre-established amount based on the poker hand ranking achieved by the player's completed hand.

41. The method of claim 40 in which the community cards are arranged in a triangle.

42. The method of claim 40 in which the community cards are arranged in a straight line.

43. The method of claim 40 in which the pre-established amount to be paid to the player is based on a payout table.

44. The method of claim 43 in which the payout table comprises:

| POKER HAND | PAYOUT ODDS |
|---|---|
| ROYAL FLUSH | 250 to 1 |
| STRAIGHT FLUSH | 50 to 1 |
| FOUR-OF-A-KIND | 25 to 1 |
| FULL HOUSE | 7 to 1 |
| FLUSH | 4 to 1 |
| STRAIGHT | 3 to 1 |
| THREE-OF-A-KIND | 2 to 1 |
| TWO PAIR | 1 to 1 |
| JACKS OF BETTER | 1 for 1 |

45. The method of claim 40 further comprising:

a) allocating a portion of the wager to a progressive jackpot; and b) paying the player a pre-established amount of the progressive jackpot if the community cards form a predetermined arrangement of cards.

46. The method of claim 45 in which the player is paid all of the progressive jackpot if the community cards are cards all of the same suit.

47. The method of claim 45 in which the player is paid a portion of the progressive jackpot if the community cards are all face cards.

48. The method of claim 45 in which the player is paid all of the progressive jackpot if the community cards are cards all of the same color.

49. The method of claim 40 further comprising:

a) allocating a portion of the wager to a first progressive jackpot and a second progressive jackpot;

b) paying the player a pre-established amount of the first progressive jackpot if the community cards are all face cards; and c) paying the player a pre-established amount of the second progressive jackpot if the community cards are cards all of the same suit.

50. A method of playing a poker-style game using a standard deck of playing cards comprising:

a) dealing an initial hand of five cards to a player;

b) arranging a group of community cards comprising five cards from the deck in a predetermined pattern in which certain of the community cards are designated as a one card replacement card; a two card replacement cards; a three card replacement cards; a four card replacement cards; and a five card replacement cards;

c) permitting the player to discard up to five cards from the player's initial hand;

d) if the player discards one card, using the one card replacement card to complete the player's hand;

e) if the player discards two cards, using the two card replacement cards to complete the player's hand;

f) if the player discards three cards, using the three card replacement cards to complete the player's hand;

g) if the player discards four cards, using the four card replacement cards to complete the player's hand;

h) if the player discards five cards, using the five card replacement cards to complete the player's hand; and i) examining the player's completed hand to determine a poker hand ranking thereof.

51. The method of claim 50 in which the community cards are arranged in a triangle.

52. The method of claim 50 in which the community cards are arranged in a straight line.

53. A method of playing a poker-style game using a standard deck of playing cards comprising:

a) a player making a wager to participate in the game;

b) dealing an initial hand of five cards to a player;

c) arranging a group of community cards comprising five cards from the deck in a predetermined pattern in which certain of the community cards are designated as a one card replacement card; a two card replacement cards; a three card replacement cards; a four card replacement cards; and a five card replacement cards;

d) permitting the player to discard up to five cards from the player's initial hand;

e) if the player discards one card, using the one card replacement card to complete the player's hand;

f) if the player discards two cards, using the two card replacement cards to complete the player's hand;

g) if the player discards three cards, using the three card replacement cards to complete the player's hand;

h) if the player discards four cards, using the four card replacement cards to complete the player's hand;

i) if the player discards five cards, using the five card replacement cards to complete the player's hand;

j) examining the player's completed hand to determine a poker hand ranking thereof; and k) paying the player a pre-established amount based on the poker hand ranking achieved by the player's completed hand.

54. The method of claim 53 in which the community cards are arranged in a triangle.

55. The method of claim 53 in which the community cards are arranged in a straight line.

56. The method of claim 53 in which the pre-established amount to be paid to the player is based on a payout table.

57. The method of claim 56 in which the payout table comprises:

| POKER HAND | PAYOUT ODDS |
|---|---|
| ROYAL FLUSH | 250 to 1 |
| STRAIGHT FLUSH | 50 to 1 |
| FOUR-OF-A-KIND | 25 to 1 |
| FULL HOUSE | 7 to 1 |
| FLUSH | 4 to 1 |
| STRAIGHT | 3 to 1 |
| THREE-OF-A-KIND | 2 to 1 |
| TWO PAIR | 1 to 1 |

-continued

| POKER HAND | PAYOUT ODDS |
|---|---|
| JACKS OF BETTER | 1 for 1 |

58. The method of claim 53 further comprising:

a) allocating a portion of the wager to a progressive jackpot; and b) paying the player a pre-established amount of the progressive jackpot if the community cards form a predetermined arrangement of cards.

59. The method of claim 58 in which the player is paid all of the progressive jackpot if the community cards are a Royal Flush.

* * * * *